United States Patent [19]

Frisbie

[11] 4,267,462

[45] May 12, 1981

[54] CONTROL CIRCUIT FOR A COMPACTOR

[75] Inventor: Richard N. Frisbie, Boyle County, Ky.

[73] Assignee: Whirlpool Corporation, Benton Harbor, Mich.

[21] Appl. No.: 972,658

[22] Filed: Dec. 26, 1978

[51] Int. Cl.[3] ..... H01N 35/00

[52] U.S. Cl. ..... 307/119; 100/52; 100/53; 307/140; 307/154

[58] Field of Search ..... 307/112, 119, 120, 122, 307/116, 154, 139, 140; 100/52, 53; 361/170

[56] References Cited

U.S. PATENT DOCUMENTS

| | | | |
|---|---|---|---|
| 3,543,676 | 12/1970 | Brown | 100/52 |
| 3,613,560 | 10/1971 | Bottas | 100/52 |
| 3,821,927 | 7/1974 | Stratman | 100/73 |
| 3,831,513 | 8/1974 | Tashman | 100/52 |
| 3,962,964 | 6/1976 | Engebnetsen | 100/53 |
| 3,994,216 | 11/1976 | Difley | 100/53 |
| 4,062,282 | 12/1977 | Miller | 100/53 |
| 4,073,228 | 2/1978 | Henzl | 100/53 |

*Primary Examiner*—L. T. Hix
*Assistant Examiner*—Stafford D. Schreyer
*Attorney, Agent, or Firm*—Wegner, Stellman, McCord, Wiles & Wood

[57] ABSTRACT

A control circuit for a refuse compactor having a compacting ram driven by a reversing electric motor for compacting refuse placed in a receptacle in the compactor. A tilt switch is associated with the receptacle and a control circuit for plug reversing the ram drive motor as a result of the tilt switch sensing a tilted condition of the receptacle during the compaction operation so as to return the ram to a retracted position as a result of such sensed tilted condition. The plug reversal operation is effected during novel utilization of the normal motor direction reversing switch of the control with the tilt switch being connected selectively in series with or in parallel with the reversing switch in different embodiments of the invention.

8 Claims, 3 Drawing Figures

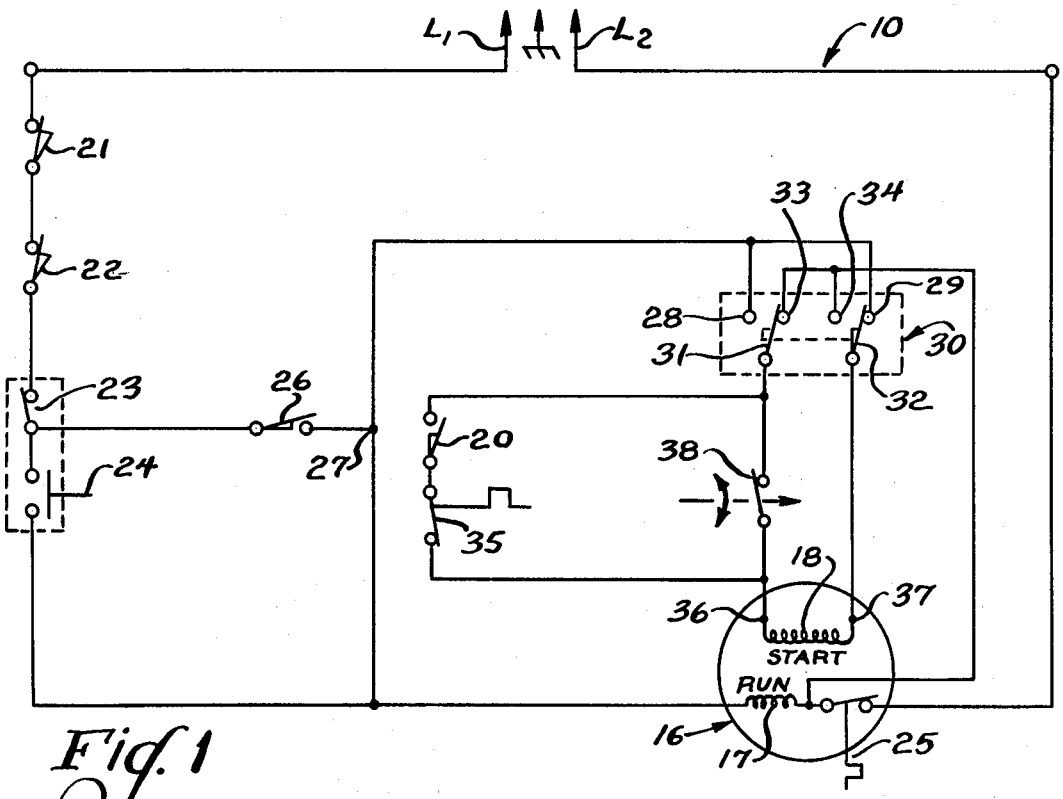
Fig. 1
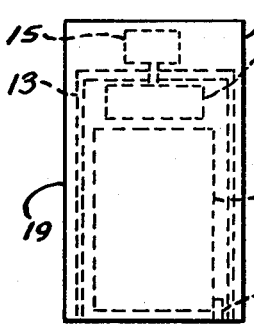
Fig. 3
Fig. 2
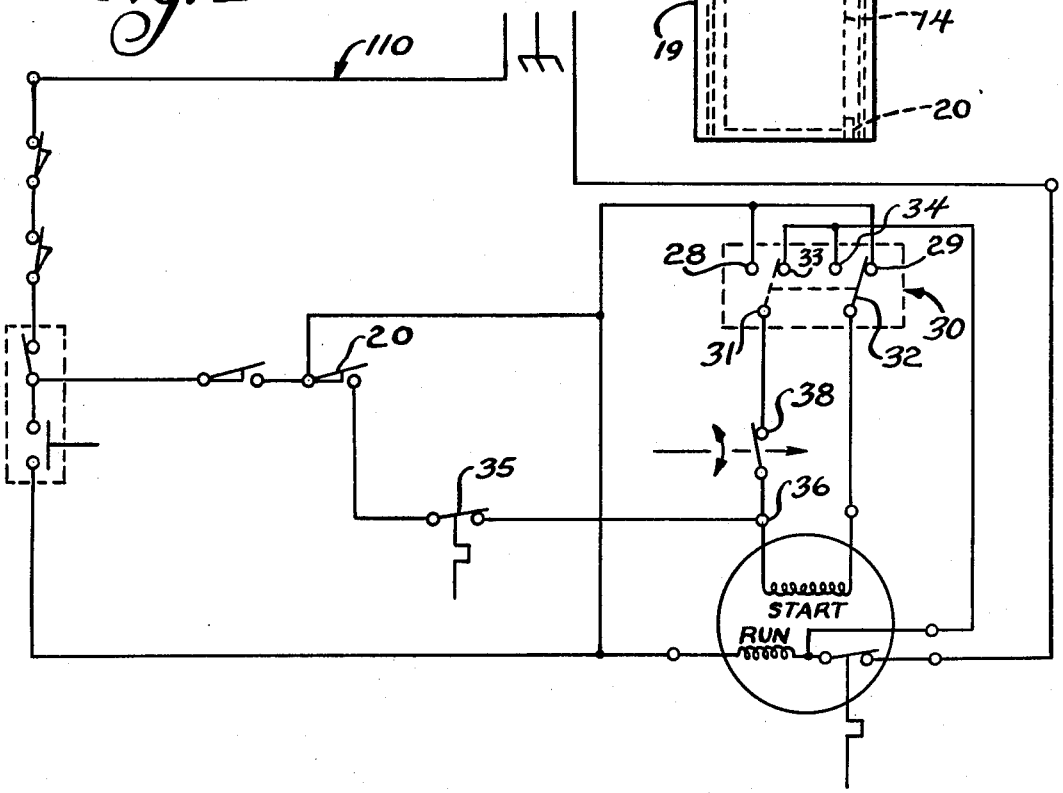

CONTROL CIRCUIT FOR A COMPACTOR

BACKGROUND OF THE INVENTION

1. Field of the Invention

This invention relates to refuse compactors and in particular to means for automatically returning the ram to a retracted position in the event the receptacle is tilted undesirably during the compaction operation.

2. Description of the Prior Art

In U.S. Pat. No. 3,543,676 of Gordon H. Brown, which patent is owned by the assignee hereof, a refuse compactor is shown having an improved control circuit for regulating the operation of the compactor automatically.

Michael J. Bottas et al, in U.S. Pat. No. 3,613,560, which patent is owned by the assignee hereof, show a refuse compactor including a control circuit which permits operation of the ram only when the drawer is substantially in the compacting position. The control circuit includes a tilt switch which is arranged in the circuit to permit reverse withdrawal movement of the ram by depression of a manually operable pushbutton.

Jerome F. Stratman et al, in U.S. Pat. No. 3,821,927, show a refuse compactor control system having a lower limit switch connected in parallel with a centrifugal switch.

In U.S. Pat. No. 3,831,513 of Philip Tashman, a portable solid waste compactor is shown having a compacting ram which has a stroke varying with the reaction force of the waste material being compacted therein. An interlock associated with the ram prevents operation of the compactor upon removal of the container in which the refuse is compacted. A guard gate is automatically closed across the refuse chute opening upon downward compacting movement of the ram to prevent injury to the operator's hand. If the guard gate is prevented from closing by an obstruction, a switch causes immediate reversal of the ram to its uppermost position.

In U.S. Pat. No. 4,062,282, owned by the assignee hereof, Samuel Jacob Miller et al show a refuse compactor having a tilt switch for terminating operation of the compacting ram in the event of a preselected tilt movement of the receptacle during the compacting operation. Means are provided for preventing movement of the receptacle sufficiently to open the receptacle safety switch during the compacting operation, thereby preventing discontinuation of energization of the ram motor during the compaction cycle which could immobilize the compactor apparatus in midcycle.

SUMMARY OF THE INVENTION

The present invention comprehends an improved refuse compactor control wherein an automatic reversal of the compacting ram is effected in the event a sensing device, such as a tilt switch, senses a tilted condition of the receptacle in which the refuse is being compacted. The control is arranged to return the ram to a retracted position as a result of a sensing of the tilted condition permitting the user to eliminate the cause of the tilting.

The control eliminates the need for the user to effect a return of the ram to the retracted position upon the occurrence of a tilting of the container and further eliminates the problem of having the ram immobilized in midcycle as has occurred in refuse compactors of the prior art.

In the illustrated embodiment, the reversal of the ram is effected in a novel and simple manner by causing a plug reversal of the ram drive motor as a result of the sensing of the tilted condition of the receptacle.

More specifically, the control circuit of the present invention utilizes a novel arrangement of the tilt switch relative to the motor reversal switch of the control so as to effect the desired plug reversal of the ram motor.

The control is arranged so as to permit such plug reversal functioning after the ram has initiated a compaction operation by moving away from the retracted position into the receptacle.

In one embodiment of the invention, the tilt reverse switch is connected in series with the reversing motor control switch, and in another embodiment, it is connected in parallel therewith. In the series arrangement, the plug reversal operation results from the disposition of the reversing motor control switch in the reverse, or retracting, mode and in the parallel arrangement, the plug reversal is effected by connecting the tilt reverse switch to the start winding of the ram drive motor so as to additionally require the reversing motor control switch to be in the reverse, or ram retracting, mode.

The improved automatic control functioning is provided in a novel and simple manner in the improved control structure of the present invention. Thus, the refuse compactor control is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a schematic wiring diagram of a control circuit for use in a refuse compactor embodying the invention;

FIG. 2 is a schematic wiring diagram illustrating a modified form of control circuit for such use; and FIG. 3 is a schematic front elevation of a compactor utilizing the improved control circuit of the invention.

DESCRIPTION OF THE PREFERRED EMBODIMENTS

In the exemplary embodiments of the invention as disclosed in the drawing, an improved control circuit generally designated 10 is shown for use in a refuse compactor generally designated 11 having a ram 12 carried on a support 13 so as to be selectively moved downwardly into and upwardly from a receptacle 14 in which refuse is placed to be compacted by the ram in the compacting functioning of the compactor. The ram is urged upwardly and downwardly by a drive generally designated 15 which may include a reversible alternating current electric drive motor 16. The drive motor may include a run winding 17 and a start winding 18, as shown in FIG. 1.

The compactor may include an outer cabinet 19. A tilted condition of the refuse receptacle 14 may be sensed by a tilt switch 20 which may be mounted within the cabinet adjacent to a portion of the receptacle.

Referring now more specifically to FIG. 1, the control circuit 10 includes a drawer safety switch 21 and a keylock safety switch 22 connected in series from a power supply line $L_1$ to a stop switch 23. An instantaneous pushbutton-type or rotary-type start switch 24 is connected in series with stop switch 23 and the run winding 17 of motor 16. The run winding, in turn, is connected through a motor protector 25 to the opposite power supply line $L_2$.

A top limit switch 26 is connected from between stop switch 23 and start switch 24 to a lead 27 also connected to the run winding 17. Lead 27 is further connected to first and second fixed contacts 28 and 29 of a motor reversing directional switch generally designated 30.

Switch 30 comprises a double pole, double throw switch having a moving contact 31 engaging fixed contact 29, and a moving contact 32 normally engaging a fixed contact 33, as shown in FIG. 1. Fixed contact 33 and a fixed contact 34 are connected together and to the junction point between the run winding 17 and motor protector 25.

Moving contact 31 is connected to the tilt switch 20 which is, in turn, connected in series with a start winding protector 35. Protector 35, in turn, is connected to one terminal 36 of the start winding 18, the other terminal 37 of the start winding being connected to the moving contact 32 of directional switch 30. A motor centrifugal switch 38 is connected between moving contact 31 and start winding terminal 36 in parallel with the series connected tilt switch 20 and start winding protector 35.

As shown, switches 21, 22 and 23 comprise normally closed single pole, single throw switches. Tilt switch 20 comprises a normally open single pole, single throw switch. In the retracted position of the ram, the top limit switch 26 is opened so as to limit the upward movement of the ram to the desired retracted position.

Control circuit 10 functions in controlling the operation of the ram in a novel and simple manner. More specifically, to initiate the compacting operation, the operator momentarily closes start switch 24 so as to energize the start winding through the directional switch 30, the moving contacts of which are disposed as shown in FIG. 1. This causes the drive motor to be suitably energized to initiate a downward movement of the ram 12. Upon release of the start switch 24 by the operator, the circuit to the run winding 17 is continued from power supply lead $L_1$ through the now closed top limit switch 26 which closes upon initial downward movement of the ram. The directional switch is similarly thrown from the forward arrangement, as shown in FIG. 1, to a reverse arrangement wherein the moving contacts engage fixed contacts 28 and 34, respectively, but only after the centrifugal switch 38 opens as a result of the motor 16 reaching a preselected speed.

In normal operation, the motor 16 is thus caused to continue to run in a forward mode until such time as the ram motion is slowed by the resistance of the refuse being compacted so as to again close the centrifugal switch 38. Thus, motor 16 is caused to initiate a reverse drive of the motor as the now reversely connected start winding 18 overrides the run winding 17 so as to effect a plug reversal of the motor automatically when the compaction reaches a preselected pressure.

The present invention utilizes the tilt switch 20 to cause an automatic plug reversal of the compactor drive motor 16 in the event the receptacle 14 is tilted sufficiently to close the switch 20 during the compaction operation. Thus, the switch 20 effectively defines a sensing element for sensing a tilted condition of the receptacle and means for automatically causing a plug reversal of the drive motor 16 as a result of such sensing. More specifically, as can be seen in FIG. 1, the tilt switch 20, being connected in parallel with the centrifugal switch 38, may cause a plug reversal of the drive motor 16 at any time during the downward compacting movement of the ram so as to initiate an automatic return to the retracted position as an incident of undesirable tilting of the receptacle. This plug reversal is effected in a manner similar to the plug reversal effected by the centrifugal switch in controlling the maximum compaction pressure, as the closing of switch 20 connects the start winding 18 to the directional switch 30 with the directional switch thrown to the reverse disposition wherein the moving contacts 31 and 32 engage fixed contacts 28 and 34, respectively.

Thus, the control circuit 10 provides an improved automatic plug reversal of the ram drive motor eliminating the need for the user of the compactor to initiate a retraction movement of the ram as has been required in the prior art structures. Further, the novel circuit arrangement utilizing the tilt switch in parallel with the centrifugal switch effectively eliminates the immobilized condition of the compactor, as has resulted in prior art structures, wherein the tilt switch merely opens the circuit to the motor.

Referring now more specifically to the control circuit 110 illustrated in FIG. 2, it may be seen that circuit 110 is generally similar to circuit 10 except that the tilt switch 20 and start winding protector 35 are connected in parallel with both the centrifugal switch 38 and directional switch 30 rather than in parallel with the centrifugal switch 38 alone. On the circuit 110, the connection of the tilt switch and start winding protector is between fixed contact 28 and terminal 36 of the start winding, the moving contacts 31 and 32 of the directional switch having been thrown to the fixed contacts 28 and 34 during forward operation of the ram.

In each of circuits 10 and 110, the start winding protector prevents damage to the start winding in the event the ram is not permitted to move reversely upwardly from the receptacle or the receptacle 14 does not reposition itself and disengage the tilt switch. In the illustrated embodiment, start winding protector 35 opens several seconds after initiation of energization of the start winding so as to prevent damage thereto. The start winding protector may be a self-resetting device so that after a preselected period of time, it will again close to reestablish the tilt-plug reversal circuit.

Thus, the improved compactor structure of the present invention provides an automatic self-reversal of the compactor ram drive so as to avoid damage to the compactor resulting from an undesirable tilted condition of the receptacle during the compaction operation. Such tilted conditions may arise from unbalanced loads and the like. While the control circuitry is extremely simple and economical of construction, it provides the highly desirable improved functioning in a novel and simple manner.

The foregoing disclosure of specific embodiments is illustrative of the broad inventive concepts comprehended by the invention.

Having described the invention, the embodiments of the invention in which an exclusive property or privilege is claimed are defined as follows:

1. In a refuse compactor having a support, a receptacle movably carried on said support for holding refuse to be compacted therein in a preselected compacting position, a ram movably carried on said support for sequential movement inwardly into said receptacle to compact refuse therein and outwardly from the receptacle to a retracted position, drive means operatively connected to said ram for forcibly reversibly driving said ram, and control means for controlling the operation of said drive means to cause said drive means to drive the ram inwardly and thereby apply a compaction force to refuse in said receptacle up to a preselected maximum compaction force and upon reaching said preselected maximum force to effect a reversal of movement of the drive means to withdraw said ram from said receptacle to said retracted position, the improvement comprising automatic reversing means, operable separately from the means for reversing movement of the ram as a function of the compaction force reaching said maximum force, for stopping inward driving of the ram after initiation of inward movement thereof in the event that the container becomes displaced from said preselected compacting position at least a preselected amount and as a result of such displacement reversely operating the drive means to return the ram outwardly to said retracted position, said drive means including a reversible motor having a start winding, and said control means including a reversing motor control switch in series with said start winding for selectively oppositely energizing the start winding to effect selectively forward and reverse starting of the motor, means for reversing the reversing motor control switch as an incident of the ram starting in the inward direction, a centrifugal switch in series with said reversing motor control switch for disconnecting the start winding after the motor speed reaches a preselected speed, and a tilt-reverse switch connected in parallel with said centrifugal switch and arranged to be closed as an incident of said receptacle being tilted at least said preselected amount for effecting energization of the start winding notwithstanding an open condition of the centrifugal switch.

2. The refuse compactor of claim 1 wherein said tilt-reverse switch is connected in series with said reversing motor control switch.

3. The refuse compactor of claim 1 wherein said tilt-reverse switch is connected in parallel with the series connection of said reversing motor control switch and centrifugal switch.

4. The refuse compactor of claim 1 further including a start winding protector connected in series with said tilt-reverse switch.

5. In a refuse compactor having a ram, a receptacle for holding refuse, means including a reversing electric motor for moving the ram from a retracted position into the receptacle to compress the refuse therein to apply thereto a maximum preselected pressure, and sensing means for sensing a tilted condition of the receptacle, the improvement comprising means for plug reversing the motor as a result of said sensing means sensing a tilted condition of the receptacle prior to the compaction of the refuse to said maximum pressure for automatically returning the ram to the retracted position, said sensing means comprising a tilt-switch and said compactor further including a top limit switch in series with said tilt switch for preventing such plug reversal of the motor until the ram has moved from the retracted position.

6. The refuse compactor of claim 5 wherein said compactor further includes a reversing switch for controlling the direction of operation of the motor and said sensing means reconnects the motor to the reversing switch only after a preselected movement of the ram away from the retracted position.

7. In a refuse compactor having a ram, a receptacle for holding refuse, means including a reversing electric motor for moving the ram from a retracted position into the receptacle to compress the refuse therein to apply thereto a maximum preselected pressure, and sensing means for sensing a tilted condition of the receptacle, the improvement comprising means for plug reversing the motor as a result of said sensing means sensing a tilted condition of the receptacle prior to the compaction of the refuse to said maximum pressure for automatically returning the ram to the retracted position, said compactor further including a reversing switch for controlling the direction of operation of the motor and said sensing means comprising a tilt switch and a top limit switch for reconnecting the motor to the reversing switch only after a preselected movement of the ram away from the retracted position, said tilt and top limit switches being connected in series during the compactor operation, the tilt switch being connected in series with the reversing switch.

8. In a refuse compactor having a ram, a receptacle for holding refuse, means including a reversing electric motor for moving the ram from a retracted position into the receptacle to compress the refuse therein to apply thereto a maximum preselected pressure, and sensing means for sensing a tilted condition of the receptacle, the improvement comprising means for plug reversing the motor as a result of said sensing means sensing a tilted condition of the receptacle prior to the compaction of the refuse to said maximum pressure for automatically returning the ram to the retracted position, said compactor including a reversing switch for controlling the direction of operation of the motor and said sensing means comprising a tilt switch and a top limit switch for reconnecting the motor to the reversing switch only after a preselected movement of the ram away from the retracted position, said tilt and top limit switches being connected in series during the compactor operation, the tilt switch being connected in parallel with the reversing switch.

* * * * *